US005877586A

United States Patent [19]

Aibara

[11] Patent Number: 5,877,586

[45] Date of Patent: Mar. 2, 1999

[54] SLOT-TYPE SHADOW MASK

[75] Inventor: Nobumitsu Aibara, Shiga, Japan

[73] Assignee: NEC Corporation, Tokyo, Japan

[21] Appl. No.: 820,172

[22] Filed: Mar. 19, 1997

[30] Foreign Application Priority Data

Mar. 19, 1996 [JP] Japan ..... 8-062570

[51] Int. Cl.[6] ..... H01J 29/07

[52] U.S. Cl. ..... 313/402; 313/408

[58] Field of Search ..... 313/402, 403, 313/408

[56] References Cited

U.S. PATENT DOCUMENTS 3,652,895 3/1972 Tsuneda et al. ..... 313/403
5,030,880 7/1991 An ..... 313/403

FOREIGN PATENT DOCUMENTS 2012046 10/1970 Germany ..... 313/403

*Primary Examiner*—Ashok Patel
*Attorney, Agent, or Firm*—Sughrue, Mion, Zinn, Macpeak & Seas, PLLC

[57] ABSTRACT

A slot-type shadow mask is provided, which enables one to avoid the problem termed the "phosphor-stripe loss" to thereby improve the quality. This shadow mask includes a plate-like body having slots for selectively allowing electron beams to pass through the mask. The slots are located in a rectangular slot area of the body. Each of the slots has a vertically elongated shape. The slots are arranged horizontally at a specific horizontal pitch and vertically at a specific vertical pitch. The slots form first to m-th slot columns, where m is a natural number. A part of the slots included in the first slot column and a part of the slots included in the m-th slot column have a first width. A part of the slots included in the second slot column and a part of the slots included in the (m−1)-th slot column have a second width. The remaining slots have a third width. The first width is smaller than the third width and the second width is larger than the third width.

11 Claims, 6 Drawing Sheets

SLOT-TYPE SHADOW MASK

BACKGROUND OF THE INVENTION

1. Field of the Invention

The present invention relates to a shadow mask and more particularly, to a slot-type shadow mask used for a color Cathode-Ray Tube (CRT).

2. Description of the Prior Art

FIG. 2 schematically shows the typical configuration of a shadow-mask type color CRT.

As shown in FIG. 2, a shadow-mask type color CRT 11 has a glass valve 12. The front part of the valve 12 constitutes a face panel 13 on which an image is displayed. A phosphor screen 14 is formed on the inner surface of the panel 13 within the valve 12. The screen 14 extends along the inner surface of the panel 13. A lot of stripes of phosphor materials for red (R), green (g) and blue (B) colors are horizontally and vertically arranged in the whole screen 14. Each of the stripes is usually of a vertically elongated shape, i.e., of a vertically extending strip.

A shadow mask 15 is fixed apart from the face panel 13 and is opposed to the phosphor screen 14 in the valve 12. The mask 15 has a large number of slots allowing selectively electron beams 17 to arrive at the phosphor screen 14 through the mask 15.

In the neck of the valve 12, three electron guns 16 for generating and emitting the electron beams 17 for R, G and B colors are loaded to be horizontally arranged in line. In other words, the guns 16 have the in-line structure.

A deflection yoke 18 is provided around the valve 12 in the vicinity of the neck of the valve 12, which deflects horizontally and vertically the electron beams 17, respectively.

The electron beams 17 for R, G and B colors, which are emitted from the corresponding electron guns 16, are deflected by the horizontal and vertical deflecting magnetic fields generated by the deflection yoke 18, and are scanned in the horizontal and vertical directions X and Y of the face panel 13 over the whole phosphor screen 14. The beams 17 passing through the slots of the shadow mask 15 strike the corresponding stripes of the phosphor materials on the screen 14 and excite them, thereby displaying a color image on the face panel 13.

To enhance the basic performance (i.e., contrast, brightness, and so on) of the CRT or imaging device, a black matrix film (not shown) is located on the inner surface of the face panel 13. The black matrix film is formed to be integrated with the phosphor screen 14. Specifically, the phosphor pixels for the R, G, and B colors are regularly arranged in a plane along the face panel 13. A black material such as graphite is coated to cover the remaining, exposed areas from the phosphor pixels in the same plane.

To reflect the irradiated light from the phosphor pixels effectively, a metal back film (not shown) is further located in the valve 12 apart from the screen 14 to extend along the inner surface of the screen 14. The metal back film is opposed to the shadow mask 15.

The conventional shadow mask 15 shown in FIG. 2 typically has a configuration as shown in FIG. 1.

As shown in FIG. 1, the shadow mask 15 has a plurality of slots 23 allowing selectively the electron beams 17 emitted from the electron guns 16 to arrive at the phosphor screen 14 through the mask 15. The slots 23, all of which have the same roughly rectangular shape, are regularly arranged in a rectangular slot area to form a mosaic in the horizontal and vertical directions X and Y on the face panel 13.

Between any vertically adjacent slots 23, bridge areas 24 are formed to maintain the mechanical strength of the shadow mask 15, respectively. The bridge area serve as electron-beam stopping areas.

The slots 23 are vertically elongated along the Y direction. Each of the slots 23 has the same length H. Each of the slots 23 has the same width $L_S$, except the slots 23 located at the edges of the slot area. The width $L_S$ may be changed regularly.

The slots 23 are arranged horizontally at a specific horizontal pitch $P_H$ and vertically at a specific vertical pitch $P_V$ in the rectangular slot area. The slots 23 constitute slot columns extending along the vertical direction Y. Horizontally adjacent two ones of the slots 23 are vertically shifted at a specific value (for example, a half of the length H of the slot 23).

The slots 23 are formed in the following way.

A patterned photoresist film is formed on the surface of the metal plate on the phosphor screen side, and then, the metal plate is selectively etched by using the photoresist film. Another patterned photoresist film is formed on the opposite surface of the metal plate to the phosphor screen, and then, the metal plate is selectively etched by using the photoresist film, thereby forming penetrating holes in the plate. The penetrating holes serve as the slots 23, respectively.

The phosphor screen 14 is formed on the inner surface of the face panel 13 in the following processes.

A photoresist film is formed on the inner surface of the face panel 13 and then, the shadow mask 15 is fixed to the valve 12 to be opposite to the face panel 13. Next, the inner surface of the face panel 13 is exposed to light three times for R, G, B colors, and developed. Thus, the unexposed areas of the photoresist film, on which a black matrix is formed, are selectively removed, thereby forming a patterned photoresist film.

Subsequently, a black matrix film is coated on the patterned photoresist film thus formed, and then the remaining photoresist film is developed. Then, the remaining, exposed areas of the photoresist film and the black matrix film located thereon are selectively removed. Thus, the black matrix film is selectively left in the areas where the phosphor pixels for the R, G, and B colors are not formed.

Further, a specific phosphor material for R, G, or B color mixed with a photoresist material is coated on the inner surface of the face panel 14, and then, is exposed to light through the shadow mask 15. The exposed phosphor material is then developed. Thus, the phosphor pixels for R, G, or B color is formed on the inner surface of the panel 14. The coating process of a phosphor material and the developing process thereof are repeated three times for R, G, and B colors.

As a result, the phosphor pixels for R, G, and B colors and the black matrix are formed on the inner surface of the panel 14.

Although the shadow mask 15 has the slots 23, the obtained black matrix has a pattern of vertically extending stripes (not slots). This is because the length H of the slots 23 of the shadow mask 15 is larger than the width $B_w$ of the bridges 24, and consequently, the exposed regions of the black matrix film exposed to the light passed through the adjacent slots 23 in each slot column are combined together to form a single stripe.

For this reason, the exposure process for forming the phosphor screen 14 is affected by the slots 23 of the shadow mask 15.

With the conventional shadow mask shown in FIG. 1, the regions of the phosphor screen 14 corresponding to each slot column of the shadow mask 15 except for the first and last slot columns are exposed to not only the main light beams passed through the slots 23 included in the corresponding slot column but also the additional light beams passed through the slots 23 included in the adjacent two slot columns.

However, the regions of the phosphor screen 14 corresponding to the first or last slot columns of the shadow mask 15 are exposed to only the additional light beams passed through the slots 23 included in the second or next-to-last slot column, together with the main light beams passed through the slots 23 included in the corresponding slot column. Therefore, these regions tend to be deficiently exposed.

Such deficient exposure of the phosphor screen 14 will cause the unwanted black regions or stripes to be left on the phosphor screen 14. In other words, the wanted phosphor pixels or stripes are not formed on the screen 14. The formation of unwanted black regions are termed the "phosphor-stripe loss".

SUMMARY OF THE INVENTION

Accordingly, an object of the present invention is to provide a slot-type shadow mask that enables one to avoid the problem termed the "phosphor-stripe loss" to thereby improve the quality.

The object together with others not specifically mentioned will become clear to those skilled in the art from the following description.

A shadow mask according to a first aspect of the present invention includes a plate-like body having slots for selectively allowing electron beams to pass through the mask. The slots are located in a rectangular slot area of the body. Each of the slots has a vertically elongated shape.

The slots are arranged horizontally at a specific horizontal pitch and vertically at a specific vertical pitch. The slots form first to m-th slot columns, where m is a natural number greater than unity.

A part of the slots included in the first slot column and a part of the slots included in the m-th slot column have a first width. A part of the slots included in the second slot column and a part of the slots included in the (m−1)-th slot column have a second width. The remaining slots have a third width.

The first width is smaller than the third width and the second width is larger than the third width.

With the shadow mask according to the first aspect, the parts of the slots included in the first and m-th slot columns have the first width smaller than the third width of the remaining slots. The parts of the slots included in the second and (m−1)-th slot columns have the second width larger than the third width of the remaining slots.

Therefore, the light beams passing through the first and m-th (i.e., last) slot columns of the shadow mask are deficient with respect to the case of the remaining slots, resulting in no wanted phosphor-stripes on a face panel. In other words, no phosphor stripes are formed by means of the first and m-th slot columns due to the phenomenon termed the "phosphor-stripe loss".

On the other hand, the light beams passing through the second and (m−1)-th (i.e., next-to-last) slot columns of the shadow mask are excessive with respect to the case of the remaining slots. This excessive exposure cancels or compensates the deficient exposure generated through the first and m-th (i.e., last) slot columns of the shadow mask.

Accordingly, the light beams passing through the second and (m−1)-th (i.e., next-to-last) slot columns of the shadow mask will create the proper exposure similar to the case of the remaining slots. This means that no phosphor stripe is formed on the face panel due to the first and m-th slot columns and as a result, the phenomenon termed the "phosphor-stripe loss" can be prevented with respect to the second and (m−1)-th slot columns. This leads to improvement of the quality of the shadow mask.

In a preferred embodiment of the shadow mask according to the first aspect, the first width is in the range of 35 to 65% of the third width, and the second width is in the range of 110 to 130% of the third width.

In another preferred embodiment of the shadow mask according to the first aspect, the parts of the slots having the first and second widths are selectively located in the vicinities of four corners of the rectangular slot area. Each of the vicinities has a vertical length in the range from (¼) to (⅛) of the vertical length of the slot area.

A shadow mask according to a second aspect of the present invention includes a plate-like body having slots for selectively allowing electron beams to pass through the mask. The slots are located in a rectangular slot area of the body. Each of the slots has an vertically elongated shape.

The slots are arranged horizontally at a specific horizontal pitch and vertically at a specific vertical pitch. The slots form first to m-th slot columns, where m is a natural number greater than unity.

A part of the slots included in the first slot column and a part of the slots included in the m-th slot column have a first width. The remaining slots have a second width.

The first width is larger than the second width.

With the shadow mask according to the second aspect, the parts of the slots included in the first and m-th slot columns have the first width larger than the first width of the remaining slots. Therefore, the light beams passing through the first and m-th (i.e., last) slot columns of the shadow mask will be excessive with respect to the case of the remaining slots.

This excessive exposure cancels or compensates the deficient exposure caused by the decrease of the additional light beams for the first and m-th slot columns.

Accordingly, the light beams passing through the first and m-th slot columns of the shadow mask will create the proper exposure similar to the case of the remaining slots. This means that no unwanted black stripe is formed on the face panel and as a result, the phenomenon termed the "phosphor-stripe loss" can be prevented. This leads to improvement of the quality of the shadow mask.

In a preferred embodiment of the shadow mask according to the second aspect, the first width is in the range of 110 to 130% of said second width.

In another preferred embodiment of the shadow mask according to the second aspect, the part of the slots which has the first width is selectively located in the vicinities of four corners of the slot area. Each of the vicinities has a vertical length in the range from (¼) to (⅛) of the vertical length of the slot area.

A shadow mask according to a third aspect of the present invention includes a plate-like body having slots for selectively allowing electron beams to pass through the mask.

The slots are located in a rectangular slot area of the body. Each of the slots has an vertically elongated shape.

The slots are arranged horizontally at a specific horizontal pitch and vertically at a specific vertical pitch. The slots form first to m-th slot columns, where m is a natural number greater than unity.

A part of the slots included in the first slot column and a part of the slots included in the m-th slot column have a first width. The remaining slots have a second width.

The first width is smaller than the second width.

With the shadow mask according to the third aspect, the parts of the slots included in the first and m-th slot columns have the first width smaller than the first width of the remaining slots. Therefore, the light beams passing through the first and m-th (i.e., last) slot columns of the shadow mask will be deficient with respect to the case of the remaining slots, resulting in no wanted phosphor stripes on a face panel. In other words, the phenomenon termed the "phosphor-stripe loss" will occur.

Accordingly, no black stripes are formed by means of the first and m-th slot columns due to the phenomenon termed the "phosphor-stripe loss", preventing the "phosphor-stripe loss" phenomenon with respect to the second and (m−1)-th slot columns.

In a preferred embodiment of the shadow mask according to the third aspect, the first width is in the range of 35 to 65% of the second width.

In another preferred embodiment of the shadow mask according to the third aspect, the part of the slots having the first width is selectively located in the vicinities of four corners of the slot area. Each of the vicinities has a vertical length in the range from (¼) to (⅛) of the vertical length of the slot area.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
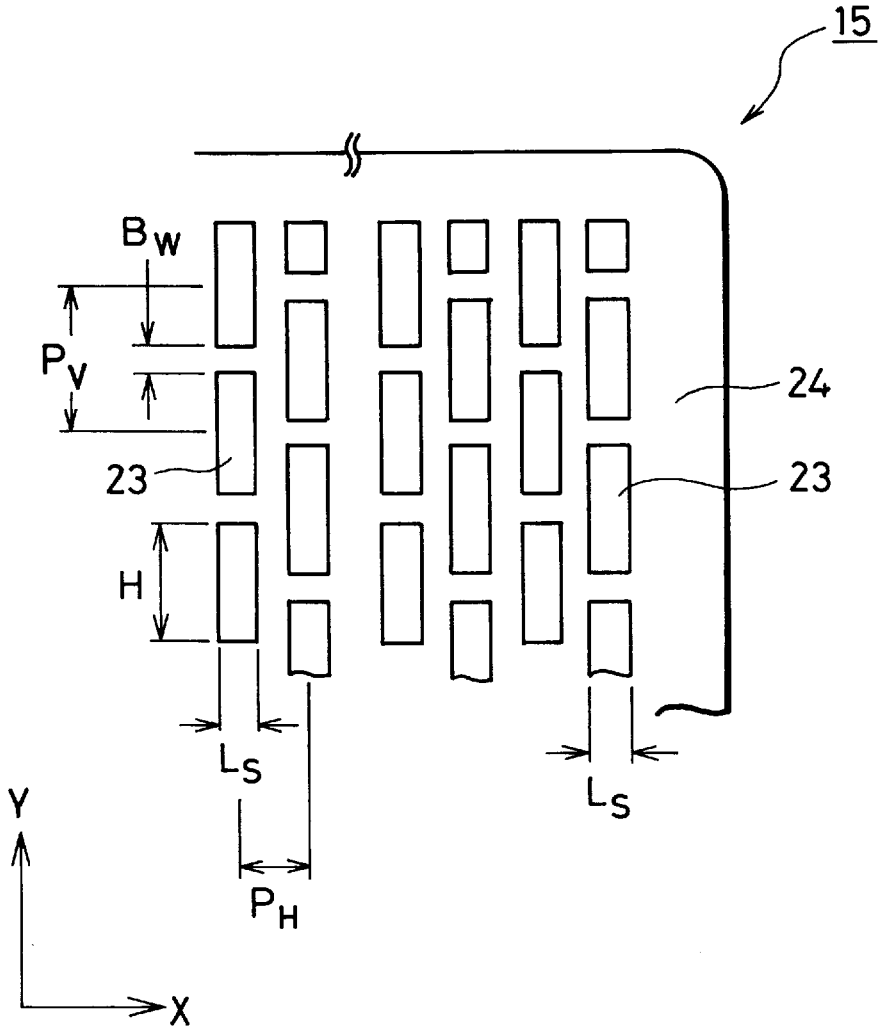
FIG. 1 PRIOR ART
FIG. 1 is a schematic, enlarged, partial plan view of a conventional shadow mask of a color CRT.
Figure 2:
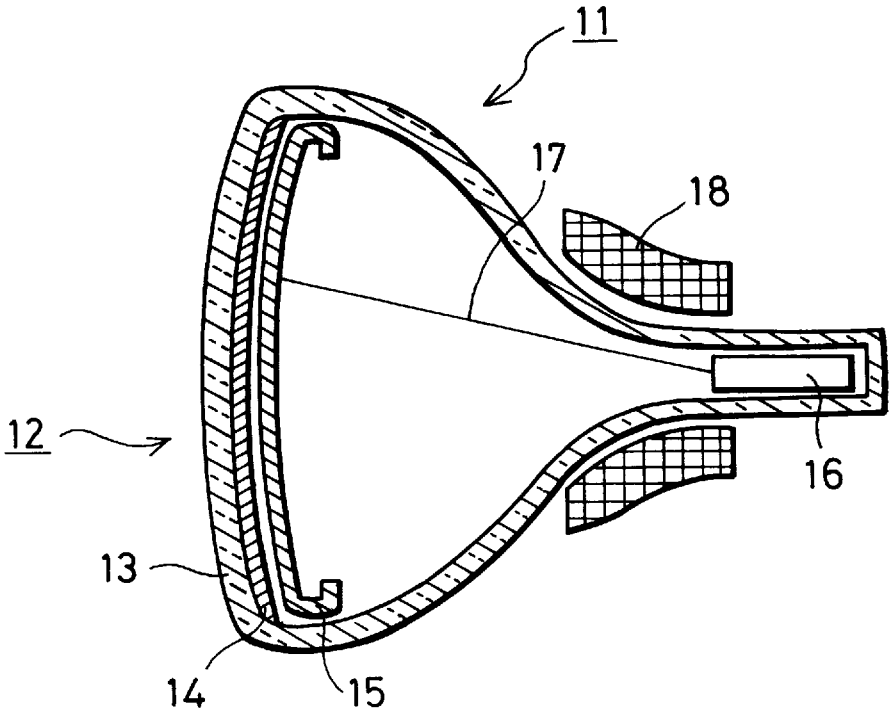
FIG. 2 PRIOR ART
FIG. 2 is a schematic cross-sectional view of a conventional shadow-mask type color CRT.

Preferred embodiments of the present invention will be described in detail below while referring to the drawings attached.

FIRST EMBODIMENT

Figure 3:
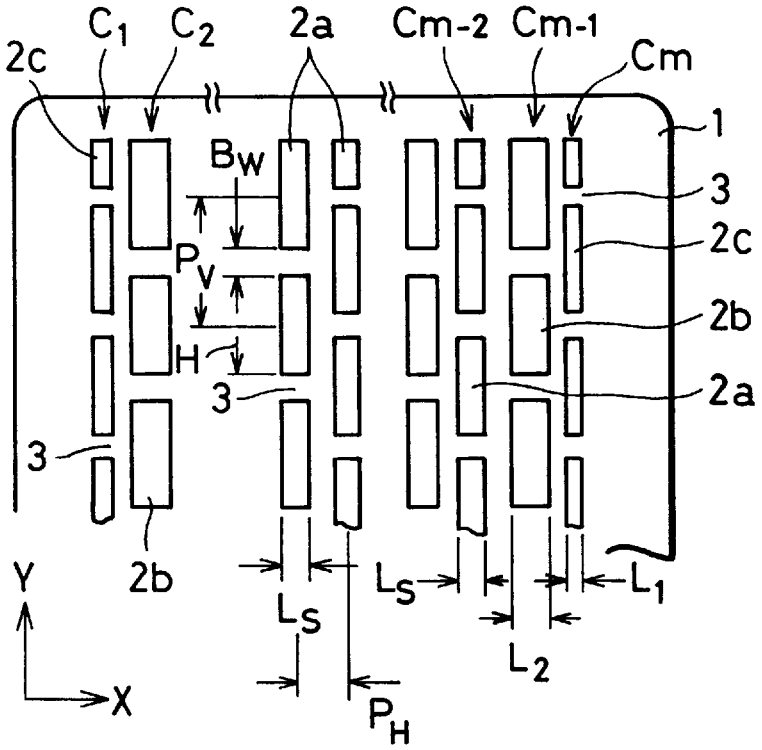
FIG. 3 is a schematic, enlarged, partial plan view of a shadow mask of a color CRT according to a first embodiment of the present invention.

As shown in FIG. 3, a shadow mask for a color CRT according to a first embodiment has a mask body 1 formed by a rectangular metal plate, and a plurality of slots 2*a*, 2*b*, and 2*c* formed in the mask body 1. The slots 2*a*, 2*b*, and 2*c* selectively allow electron beams emitted from electron guns of the CRT to arrive at a phosphor screen thereof through this mask.

Figure 9:
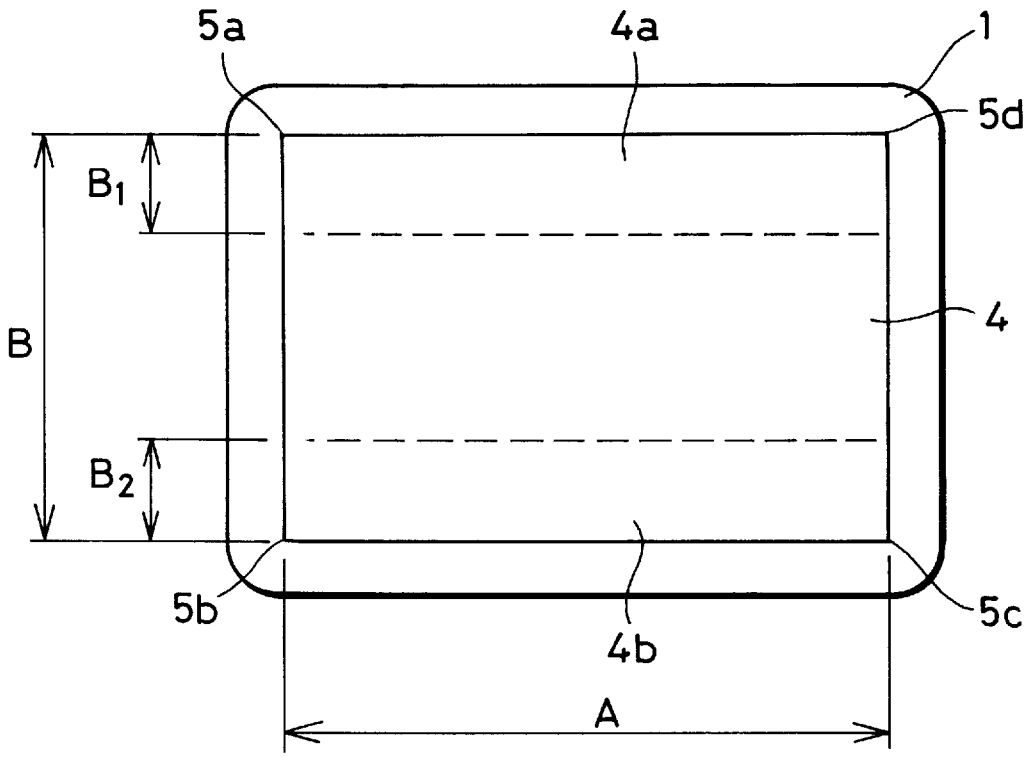
FIG. 9 is a schematic plan view of the shadow mask according to the first, second, and third embodiments of FIGS. 3, 5, and 7.

As shown in FIG. 9, the slots 2*a*, 2*b*, and 2*c* are regularly arranged in a rectangular slot area 4 to form a mosaic in the horizontal and vertical directions X and Y on a face panel of the CRT. The area 4 has a horizontal length A and a vertical length B, where A is longer than B (i.e., A>B).

As shown in FIG. 3, the slots 2*a*, 2*b*, and 2*c* constitute first to m-th slot columns $C_1$ to $C_m$ extending along the vertical direction Y, where m is a natural number greater than unity. The first to m-th slot columns $C_1$ to $C_m$ are arranged at a fixed horizontal pitch $P_H$ in the horizontal direction X. The slots 2*a*, 2*b*, and 2*c* included in the first to m-th slot columns $C_1$ to $C_m$ are arranged at a fixed vertical pitch $P_V$ in the vertical direction Y.

Between any vertically adjacent slots 2*a*, 2*b*, and 2*c*, bridge areas 3 are formed to maintain the mechanical strength of the shadow mask, respectively. The bridge areas 3 serve as electron-beam stopping areas.

The slots 2*a*, 2*b*, and 2*c* included in the horizontally adjacent two ones of the slot columns $C_1$ to $C_m$ are vertically shifted at a specific value (for example, a half of the length H of the slots 2*a*, 2*b*, and 2*c*).

Each of the slots 2*a*, 2*b*, and 2*c* has a vertically elongated shape and has a length H, except for those located at the edges of the slot area 4.

Each of the slots 2*a* included in the third to (m−2)-th slot columns $C_3$ to $C_{m-2}$ has a regular width $L_S$, except for the slots 2*a* located at the edges of the slot area 4. Each of the slots 2*b* included in the second and (m−1)-th slot columns $C_2$ and $C_{m-1}$ has a width $L_2$ larger than the regular width $L_S$ of the slots 2*a*, except for the slots 2*b* located at the edges of the slot area 4. Each of the slots 2*c* included in the first and m-th slot columns $C_1$ to $C_m$ has a width $L_1$ smaller than the regular width $L_S$ of the slots 2*a*, except for the slots 2*c* located at the edges of the slot area 4.

Figure 4:
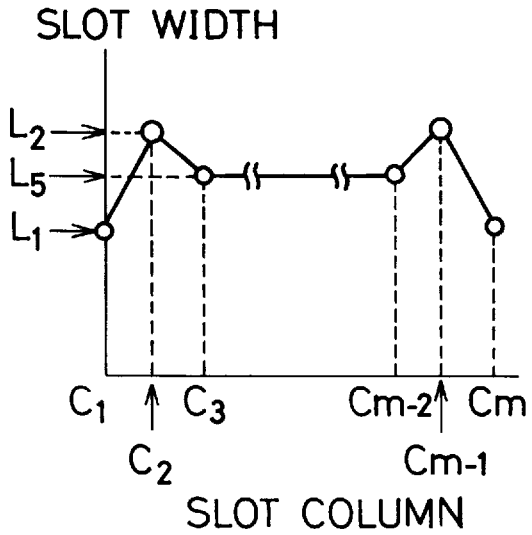
FIG. 4 is a graph showing the relationship of the slot width with the slot columns in the shadow mask according to the first embodiment of FIG. 3.

FIG. 4 shows the change of the slot width with respect to the slot columns $C_1$ to $C_m$ in the shadow mask according to the first embodiment of FIG. 3. It is clearly seen from FIG. 4 that the slot width is kept at $L_S$ in the third to (m−2)-th slot columns $C_3$ to $C_{m-2}$, that the slot width increases from $L_S$ to $L_2$ in the second and (m−1)-th slot columns $C_2$ and $C_{m-1}$, and that the slot width decreases from $L_2$ to $L_1$ in the first and m-th (i.e., last) slot columns $C_1$ to $C_m$.

With the shadow mask according to the first embodiment of FIGS. 3 and 4, as described above, the slots 2*c* included in the first and m-th slot columns $C_1$ and $C_m$ have the width $L_1$ smaller than the regular width $L_S$ of the slots 2*a* in the third to (m−2)-th columns $C_3$ to $C_{m-2}$. Further, the slots 2*b* included in the second and (m−1)-th slot columns $C_2$ and $C_{m-1}$ have the width $L_2$ larger than the regular width $L_S$ of the slots 2*a*.

Therefore, the light beams passing through the slots 2*c* in the first and m-th (i.e., last) slot columns $C_1$ and $C_m$ of the shadow mask are deficient with respect to the case of the regular slots 2*a*, resulting in no phosphor stripes on a face panel. In other words, no phosphor stripes are formed by means of the first and m-th slot columns $C_1$ and $C_m$ due to the phenomenon termed the "stripe loss".

On the other hand, the light beams passing through the slots 2b in the second and (m−1)-th (i.e., next-to-last) slot columns $C_2$ and $C_{m-1}$ of the shadow mask are excessive with respect to the case of the regular slots 2a. This excessive exposure cancels the deficient exposure generated through the first and m-th slot columns $C_1$ and $C_m$ of the shadow mask.

Accordingly, the light beams passing through the slots 2b in the second and (m−1)-th slot columns $C_2$ and $C_{m-1}$ of the shadow mask will create the proper exposure similar to the case of the regular slots 2a. This means that no black stripe is formed on the face panel due to the first and m-th slot columns $C_1$ and $C_{m-1}$ and as a result, the phenomenon termed the "phosphor-stripe loss" can be prevented with respect to the second and (m−1)-th slot columns $C_1$ and $C_{m-1}$. This leads to improvement of the quality of the shadow mask.

Preferably, the width $L_2$ is approximately in the range of 110 to 130% of the regular width $L_S$, and the width $L_1$ is approximately in the range of 35 to 65% of the regular width $L_S$.

If the width $L_2$ is smaller than 110% of the regular width $L_S$, the decrease of the exposure through the slots 2c is unable to be compensated sufficiently. If the width $L_2$ is larger than 130% of the regular width $L_S$, the compensation to the exposure decrease through the slots 2c is excessive, thereby excessively exposing the regions on the face panel corresponding to the slots 2b.

If the width $L_1$ is smaller than 35% of the regular width $L_S$, the exposure of the regions on the face panel corresponding to the slots 2c is deficient. If the width $L_1$ is larger than of the regular width $L_S$, an unwanted phosphor stripe tends to be formed in the regions on the face panel corresponding to the slots 2c.

Further, it is preferred that the slots 2b and 2c having the widths $L_2$ and $L_1$ are selectively located in the vicinities of four corners 5a, 5b, 5c, and 5d of the slot area 4 shown in FIG. 9. This is because the exposure deficiency in the regions on the face panel increases as the distance of the regions to be exposed from the exposing light source becomes longer. Accordingly, it is preferred that the vicinities have vertical lengths B1 and B2 ranging from (¼) to (⅛) of the vertical length B of the slot area 4.

If B1 and B2 are in the range from (¼)B to (⅛)B, the "stripe loss" can be prevented without degradation in the displaying performance of the CRT, which was found through the inventor's test.

SECOND EMBODIMENT

Figure 5:
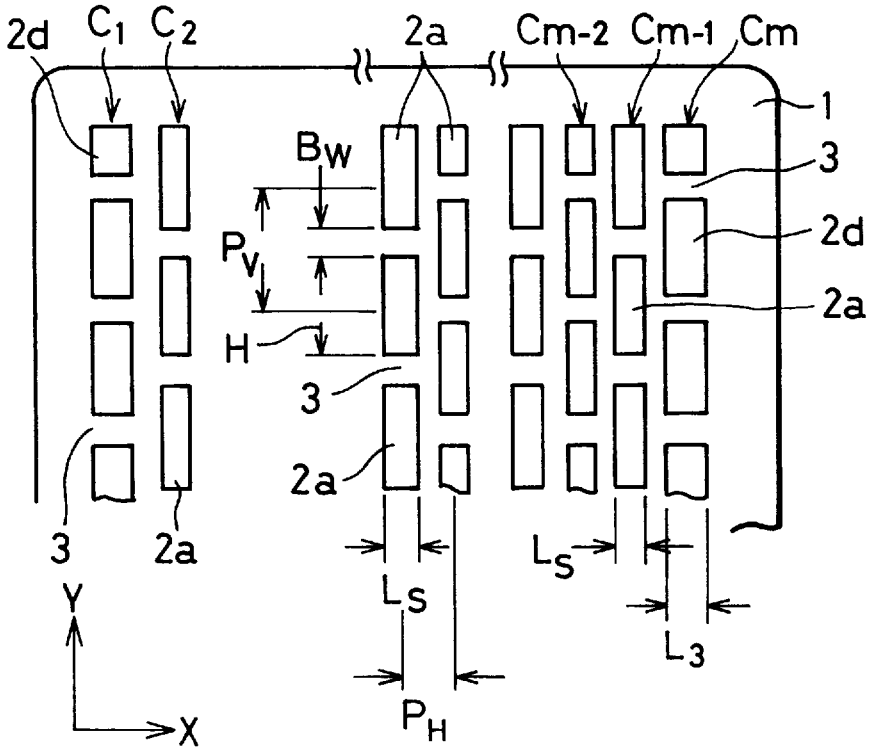
FIG. 5 is a schematic, enlarged, partial plan view of a shadow mask of a color CRT according to a second embodiment of the present invention.

FIG. 5 shows a shadow mask for a color CRT according to a second embodiment, which is the same in configuration as that of the first embodiment of FIGS. 3 and 4 except for the slot width. Accordingly, the description relating to the same configuration is omitted here by adding the same reference numerals or characters to the corresponding elements in FIGS. 5 and 6 for the sake of simplification of description.

As shown in FIG. 5, the slots 2a and 2d constitute first to m-th slot columns $C_1$ to $C_m$ extending along the vertical direction Y. The slots 2a and 2d included in the first to m-th slot columns $C_1$ to $C_m$ are arranged at a fixed vertical pitch $P_V$ in the vertical direction Y.

Each of the slots 2a included in the second to (m−1)-th slot columns $C_2$ to $C_{m-1}$ has the regular width $L_S$, except for the slots 2a located at the edges of the slot area 4.

Each of the slots 2d included in the first and m-th (i.e., last) slot columns $C_1$ and $C_m$ has a width $L_3$ larger than the regular width $L_S$ of the slots 2a, except for the slots 2d located at the edges of the slot area 4.

Figure 6:
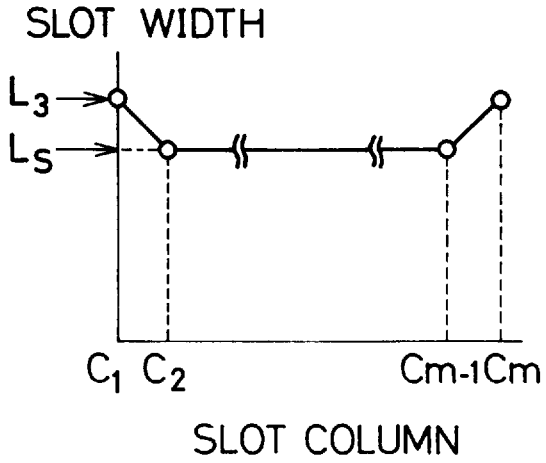
FIG. 6 is a graph showing the relationship of the slot width with the slot columns in the shadow mask according to the second embodiment of FIG. 5.

FIG. 6 shows the change of the slot width with respect to the slot columns $C_1$ to $C_m$ in the shadow mask according to the second embodiment of FIG. 5.

It is clearly seen from FIG. 6 that the slot width is kept at $L_S$ in the second to (m−1)-th slot columns $C_2$ to $C_{m-1}$, and that the slot width increases from $L_S$ to $L_3$ in the first and m-th slot columns $C_1$ and $C_m$.

With the shadow mask according to the second embodiment of FIGS. 5 and 6, as described above, the slots 2d included in the first and m-th slot columns $C_1$ and $C_m$ have the width $L_3$ larger than the regular width $L_S$ of the slots 2a in the second to (m−1)-th columns $C_2$ to $C_{m-1}$. Therefore, the deficient exposure to be generated in the regions on the face panel corresponding to the first and m-th slot columns $C_1$ and $C_m$ can be compensated.

Accordingly, the light beams passing through the slots 2d in the first and m-th slot columns $C_1$ and $C_m$ will create the proper exposure similar to the case of the regular slots 2a. This means that no black stripe is formed on the face panel and as a result, the phenomenon termed the "phosphor-stripe loss" can be prevented with respect to the first and m-th slot columns. This leads to improvement of the quality of the shadow mask.

Preferably, the width $L_3$ is approximately in the range of 110 to 130% of the regular width $L_S$. The If the width $L_3$ is smaller than 110% of the regular width $L_S$, the compensation to the exposure deficiency through the slots 2d is not sufficient. If the width $L_3$ is larger than 130% of the regular width $L_S$, the compensation to the exposure deficiency through the slots 2d is excessive, thereby excessively exposing the regions on the face panel corresponding to the slots 2d.

Further, it is preferred that the slots 2d having the widths $L_3$ are selectively located in the vicinities of four corners 5a, 5b, 5c, and 5d of the slot area 4 shown in FIG. 9. This is because the same reason as that of the first embodiment.

THIRD EMBODIMENT

Figure 7:
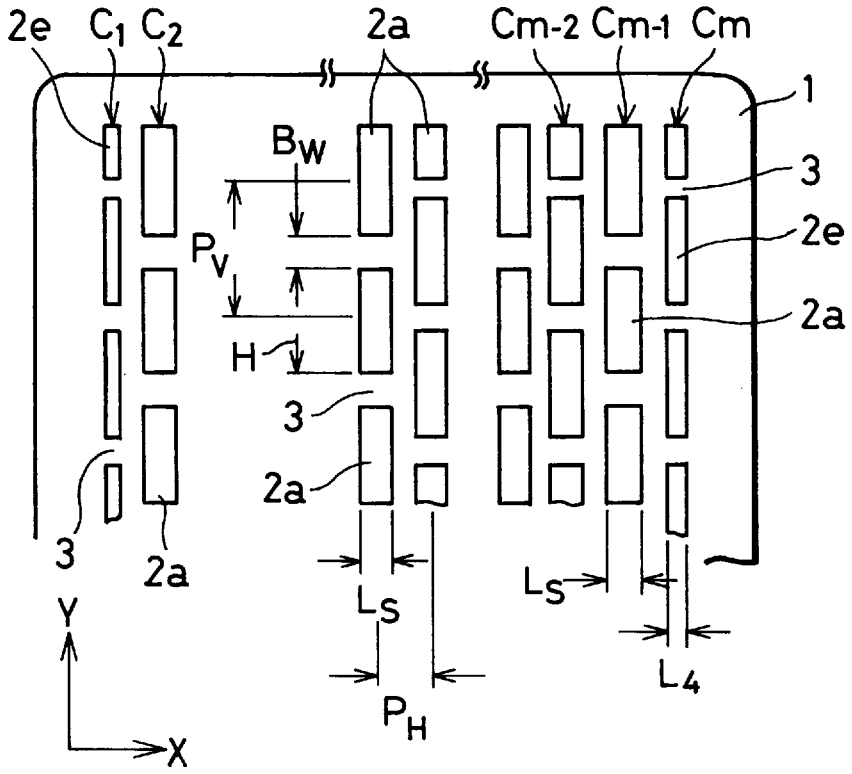
FIG. 7 is a schematic, enlarged, partial plan view of a shadow mask of a color CRT according to a third embodiment of the present invention.

FIG. 7 shows a shadow mask for a color CRT according to a third embodiment, which is the same in configuration as that of the first embodiment of FIGS. 3 and 4 except for the slot width. Accordingly, the description relating to the same configuration is omitted here by adding the same reference numerals or characters to the corresponding elements in FIGS. 7 and 8 for the sake of simplification of description.

As shown in FIG. 7, the slots 2a and 2e constitute first to m-th slot columns $C_1$ to $C_m$ extending along the vertical direction Y. The slots 2a and 2e included in the first to m-th slot columns $C_1$ to $C_m$ are arranged at a fixed vertical pitch $P_V$ in the vertical direction Y.

Each of the slots 2a included in the second to (m−1)-th slot columns $C_2$ to $C_{m-1}$ has the regular width $L_S$, except for the slots 2a located at the edges of the slot area 4.

Each of the slots 2e included in the first and m-th (i.e., last) slot columns $C_1$ and $C_m$ has a width $L_4$ smaller than the regular width $L_S$ of the slots 2a, except for the slots 2e located at the edges of the slot area 4.

Figure 8:
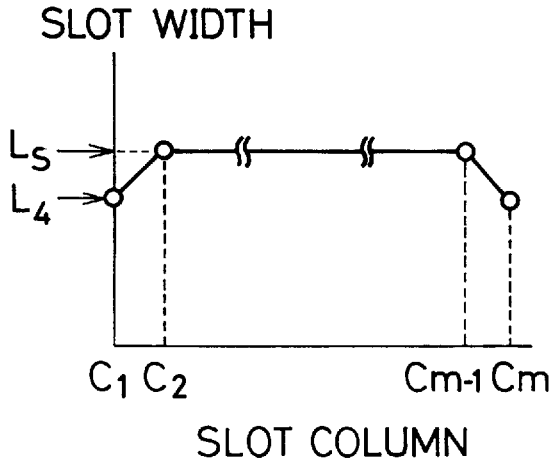
FIG. 8 is a graph showing the relationship of the slot width with the slot columns in the shadow mask according to the third embodiment of FIG. 7.

FIG. 8 shows the change of the slot width with respect to the slot columns $C_1$ to $C_m$ in the shadow mask according to the third embodiment of FIG. 7.

It is clearly seen from FIG. 8 that the slot width is kept at $L_S$ in the second to (m−1)-th slot columns $C_2$ to $C_{m-1}$, and that the slot width decreases from $L_S$ to $L_4$ in the first and m-th slot columns $C_1$ and $C_m$.

With the shadow mask according to the third embodiment of FIGS. 7 and 8, as described above, the slots 2*e* included in the first and m-th slot columns $C_1$ and $C_m$ have the width $L_4$ smaller than the regular width $L_S$ of the slots 2*a* in the second to (m−1)-th columns $C_2$ to $C_{m-1}$. Therefore, the exposure to be generated in the regions on the face panel corresponding to the first and m-th slot columns $C_1$ and $C_m$ can be decreased.

Accordingly, the light beams passing through the slots 2*e* in the first and m-th slot columns $C_1$ and $C_m$ will not create any phosphor-stripes unlike the case of the regular slots 2*a*. This means that no phosphor stripe is formed on the face by the slots 2*e* and as a result, the phenomenon termed the "phosphor-stripe loss" can be prevented with respect to the slot 2*a*. This leads to improvement of the quality of the shadow mask.

Preferably, the width $L_4$ is approximately in the range of 35 to 65% of the regular width $L_S$.

If the width $L_4$ is smaller than 35% of the regular width $L_S$ the compensation to the exposure deficiency through the slots 2*a* in the second and (m−1)-th slot columns $C_2$ and $C_{m-1}$ is not sufficient. If the width $L_3$ is larger than 65% of the regular width $L_S$, an unwanted black stripe tends to be formed.

Further, it is preferred that the slots 2*e* having the width $L_4$ are selectively located in the vicinities of four corners 5*a*, 5*b*, 5*c*, and 5*d* of the slot area 4 shown in FIG. 9. This is because the same reason as that of the first embodiment.

The shadow mask according to the first to third embodiments are able to be realized by making the penetrating slots of the patterned resist film for forming the slots 2*b*, 2*c*, 2*d*, and 2*e* smaller or larger, or deviating the etching patterns for forming the slots 2*b*, 2*c*, 2*d*, and 2*e* on the both sides of the shadow mask without changing the size of the penetrating holes of the patterned resist film.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A shadow mask used for a cathode-ray tube, comprising:

a plate-like body having slots for selectively allowing electron beams to pass therethrough;

said slots being located in a rectangular slot area of said body;

each of said slots having a vertically elongated shape;

said slots being arranged horizontally at a specific horizontal pitch and vertically at a specific vertical pitch; and said slots forming first to m-th slot columns, where m is a natural number greater than unity;

wherein a part of said slots included in said first slot column and a part of said slots included in said m-th slot column have a first width, a part of said slots included in said second slot column and a part of said slots included in said (m−1)-th slot column have a second width, and a remainder of said slots have a third width; and wherein said first width is smaller than said third width, and said second width is larger than said third width.

2. A shadow mask as claimed in claim 1, wherein said first width is in the range of 35 to 65% of said third width;

and wherein said second width is in the range of 110 to 130% of said third width.

3. A shadow mask as claimed in claim 1, wherein said parts of said slots having said first and second widths are selectively located in the vicinities of four corners of said slot area;

and wherein each of the vicinities has a vertical length in the range from (¼) to (⅛) of a vertical length of said slot area.

4. A shadow mask used for a cathode-ray tube, comprising:

a plate-like body having slots for selectively allowing electron beams to pass therethrough;

said slots being located in a slot area of said body;

each of said slots having substantially a same vertically elongated shape;

said slots being arranged horizontally at a specific horizontal pitch;

said slots being arranged vertically at a specific vertical pitch;

said slots forming first to m-th slot columns, where m is a natural number greater than unity;

wherein a part of said slots included in said first slot column and a part of said slots included in said m-th slot column have a first width, and a remainder of said slots have a second width;

and wherein said first width is larger than said second width; and wherein said slots having said first width allow a sufficient amount of light beams to pass therethrough so as to compensate for additional light beams passing through slots on only one side of said slots having said first width, thereby creating phosphor stripes on a phosphor screen in regions corresponding to said first and m-th slot columns, respectively.

5. A shadow mask as claimed in claim 4, wherein said first width is in the range of 110 to 130% of said second width.

6. A shadow mask as claimed in claim 4, wherein said part of said slots having said first width is selectively located in the vicinities of four corners of said slot area;

and wherein each of the vicinities has a vertical length in the range from (¼) to (⅛) of a vertical length of said slot area.

7. A shadow mask as claimed in claim 4, wherein each of said slots included in said first slot column and each of said slots included in said m-th slot column have said first width.

8. A shadow mask used for a cathode-ray tube, comprising:

a plate-like body having slots for selectively allowing electron beams to pass therethrough;

said slots being located in a slot area of said body;

each of said slots having a vertically elongated shape;

said slots being arranged horizontally at a specific horizontal pitch;

said slots being arranged vertically at a specific vertical pitch;

said slots forming first to m-th slot columns, where m is a natural number greater than unity;

wherein a part of said slots included in said first slot column and a part of said slots included in said m-th slot column have a first width, and a remainder of said slots have a second width;

and wherein said first width is smaller than said second width so that light passing through and adjacent to said slots having said first width is not sufficient to create phosphor stripes on a phosphor screen in regions corresponding to said first and m-th slot columns, respectively.

9. A shadow mask as claimed in claim 8, wherein said first width is in the range of 35 to 65% of said second width.

10. A shadow mask as claimed in claim 8, wherein said part of said slots having said first width is selectively located in the vicinities of four corners of said slot area; and wherein each of the vicinities has a vertical length in the range from (¼) to (⅛) of a vertical length of said slot area.

11. A shadow mask as claimed in claim 8, wherein each of said slots included in said first slot column and each of said slots included in said m-th slot column have said first width.

* * * * *

UNITED STATES PATENT AND TRADEMARK OFFICE

CERTIFICATE OF CORRECTION

PATENT NO. : 5,877,586
DATED : March 2, 1999
INVENTOR(S) : Nobumitsu AIBARA

It is certified that error appears in the above-identified patent and that said Letters Patent is hereby corrected as shown below:

Column 6, line 52, delete "$C_1$" and insert --$C_2$--.

Column 9, line 25, delete "black" and insert --phosphor--.

Signed and Sealed this

Seventh Day of September, 1999

*Attest:*

Q. TODD DICKINSON

*Attesting Officer*

*Acting Commissioner of Patents and Trademarks*